US007077729B2

(12) United States Patent
Miyazawa

(10) Patent No.: US 7,077,729 B2
(45) Date of Patent: Jul. 18, 2006

(54) ASPHERICAL SURFACE PROCESSING METHOD, ASPHERICAL SURFACE FORMING METHOD AND ASPHERICAL SURFACE PROCESSING APPARATUS

(75) Inventor: Makoto Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/975,373

(22) Filed: Oct. 29, 2004

(65) Prior Publication Data

US 2005/0118929 A1 Jun. 2, 2005

(30) Foreign Application Priority Data

Oct. 29, 2003 (JP) ..... 2003-369066

(51) Int. Cl.
*B24B 1/00* (2006.01)

(52) U.S. Cl. ..... 451/42; 451/5

(58) Field of Classification Search ..... 451/42, 451/43, 54, 57, 5, 240, 255, 256, 277, 323
See application file for complete search history.

(56) References Cited

U.S. PATENT DOCUMENTS 5,195,407 A * 3/1993 Takeno et al. ..... 82/1.11
6,276,994 B1 * 8/2001 Yoshida et al. ..... 451/41
6,568,990 B1 * 5/2003 Siders et al. ..... 451/5
6,602,110 B1 * 8/2003 Yi et al. ..... 451/9
2002/0160690 A1 10/2002 Miyazawa et al.

FOREIGN PATENT DOCUMENTS

| | | | |
|---|---|---|---|
| JP | 63-062641 | A1 | 3/1988 |
| JP | 10-175149 | A | 6/1998 |
| JP | 2002-283204 | A | 10/2002 |
| JP | 3367102 | B2 | 11/2002 |
| WO | WO 01/60553 | A1 | 8/2001 |

* cited by examiner

*Primary Examiner*—Dung Van Nguyen
(74) *Attorney, Agent, or Firm*—Sughrue Mion, PLLC

(57) ABSTRACT

An aspherical surface processing method involves a workpiece to be processed by rotating around a rotation axis, and a rotational tool movable relative to the workpiece in the same direction as the rotation axis of the workpiece and in a direction perpendicular to the rotation axis of the workpiece. The rotational tool is shifted in a fixed direction with a predetermined feed pitch in a partial or entire region from a center of the rotation axis of the workpiece to a periphery of the workpiece in the direction perpendicular to the rotation axis of the workpiece to process the workpiece into a non-axisymmetrical and aspherical surface.

8 Claims, 12 Drawing Sheets

ASPHERICAL SURFACE PROCESSING METHOD, ASPHERICAL SURFACE FORMING METHOD AND ASPHERICAL SURFACE PROCESSING APPARATUS

CROSS-REFERENCE TO RELATED APPLICATION

This application claims priority from JPA 2003-369066, the complete disclosure of which is herein incorporated by reference in its entirety for all purposes.

TECHNICAL FIELD

The present invention relates to an aspherical surface processing method, an aspherical surface forming method, and an aspherical surface processing apparatus capable of rapidly grinding and cutting an aspherical surface having a large difference between a concave and a convex portion.

BACKGROUND

A so-called progressive-power lens having no dividing line has been widely used as a spectacle lens for correcting presbyopia. A recent proposal has been a so-called inside surface progressive lens, in which a progressive surface or a curved surface is formed by synthesizing a progressive surface and a toric surface provided on an eyeball-side concave surface. The inside surface progressive lens is capable of reducing oscillation and distortion, which are drawbacks of the progressive-power lens, offering considerable improvements in optical characteristics. A related-art reference concerning a technique for creating a non-axisymmetrical and aspherical surface, such as a progressive-surface on a concave surface of a spectacle lens, has been disclosed in Japanese Patent No. 3,367,102 and JP-A-10-175149.

An aspherical surface processing apparatus, for creating a non-axisymmetrical and aspherical surface by controlling three axes, successively positions a rotational tool on a predetermined location by using three axes of an X-axis table, a Y-axis table, and a workpiece rotating means. Thus, it creates a lens shape in accordance with a lens shape design by grinding and cutting.

The following is an outline of the control method: calculating a rotation position of a workpiece by an encoder while rotating the workpiece, and controlling the three axes of the X-axis table, the Y-axis table, and the workpiece rotating means in synchronism with the rotation position.

A normal control processing method, as a conventional shape-creation control method using the aspherical surface processing apparatus of this type, is herein described with reference to FIGS. 12A, 12B, 13, and 14. FIG. 12A is a schematic view illustrating a processed surface of a lens processed by the normal control processing method. FIG. 12A is a front view of the lens, while FIG. 12B is a cross-sectional view of the lens taken along a line B–B' in FIG. 12A. FIG. 13 is a conceptual view showing the normal control processing method. FIG. 14 is a conceptual view showing a center position of a rotational tool in an X-axis direction in the normal control processing method.

Numerical value data used for numerical control in the normal control processing method is now explained using an arbitrary point Qx shown in FIG. 12A. In the numerical value data for numerical control in the normal control processing method, a spiral specified by a feed pitch P from a periphery of a round lens to a rotation center is supposed, and coordinate values of respective intersections of lines radially extending from the rotation center of the lens at intervals of a predetermined angle and the spiral are given by a rotation angle (Θ) and a distance from the rotation center (radius Rx) of the lens. Also, a height (y) in accordance with a surface shape in the Y-axis direction passing through not-shown respective intersections is obtained. These three values are determined as coordinate values (Θ, Rx, y) of a processing point.

A toric surface is a curved surface which includes a curve having the minimum curvature along a line A–A' (base curve), and a curve having the maximum curvature along a line B–B' (cross curve) perpendicular to the line A–A'. When the difference in curvature between the base curve and the cross curve is large, a cross section taken along the cross curve becomes a curve surface configuration having both extremely thick end portions and a thin central portion as illustrated in FIG. 12B. A rotational tool 214 reciprocates between a height of the portion having the minimum thickness and a height of the portion having the maximum thickness, i.e., in the Y-axis direction every time the rotational tool 214 rotates 180 degrees. For example, the lens rotates 90 degrees from the A–A' cross section to the B–B' cross section as illustrated in FIG. 13, the rotational tool 214 shifts in the plus direction of the Y-axis from an arbitrary processing point Qn of the portion having the minimum thickness to an arbitrary processing point Qnm at the maximum height.

The tip of the rotational tool 214 used for the grinding and cutting has a circular arc cross section (hereinafter referred to as "round shape"). In the normal control, for example, the center of the round shape portion of the tip of the rotational tool 214 is positioned in a normal direction established at the processing point Qn of the lens.

More specifically, at the arbitrary processing point Qn on the curve having the minimum thickness (base curve, A–A' cross section), a center point Pn of the rotational tool 214 is positioned in the normal direction established at the processing point Qn. At an arbitrary point Qnm on the curve having the maximum height (cross curve, B–B' cross section) with the lens rotated 90 degrees from the processing point Qn, a center point Pnm of the rotational tool 214 is positioned in the normal direction established at the processing point Qnm. At this stage, the processing point Qnm shifts a quarter of a pitch from the processing point Qn toward the center in the X-axis direction. The rotational tool 214 moves ΔY in the plus direction of the Y-axis and Xm toward the center in the X-axis direction relatively during the shift from the processing point Qn to the processing point Qnm. At an arbitrary processing point Qnr on the curve having the minimum height (base curve, A–A' cross section) with the lens rotated further 90 degrees, the rotational tool 214 shifts in the minus direction of the Y-axis though not shown in the figure. At this stage, since the speed of the outward movement with reduction in thickness is larger than the speed of the movement to the center of the feed pitch, the rotational tool 214 relatively shifts Xr toward the periphery as illustrated in FIG. 14. More specifically, the cross curve on the B–B' cross section provides an inflection point at which the shift direction changes to the opposite. Thus, the movement direction of the rotational tool 214 alters to the opposite on the boundary cross curve on the B–B' cross section, so that the rotational tool 214 reciprocates in the Y-axis and X-axis directions.

In the normal control processing method, the processing points are located at the intersections of the spiral and the radially extending lines as illustrated in FIG. 12A, and the center position of the tip of the rotational tool 214 is positioned in the normal directions established at the processing points. More specifically, in the normal control processing method, the rotational tool 214 grinds and cuts a workpiece while forming a complicated zigzag spiral track by repeatedly altering the movement direction of the rotational tool 214 to the opposite direction as described above.

SUMMARY OF THE INVENTION

According to the normal control processing method by using the aspherical surface processing apparatus as described above, the X-axis table finely reciprocates the workpiece in the X-axis direction, and the Y-axis table finely reciprocates the rotational tool in the Y-axis direction. Thus, the reciprocating movement control over the X-axis table and the reciprocating movement control over the Y-axis table interweave with each other, resulting in complicated control over both of the tables. When a toric or other surface for correcting strong astigmatism, which has a large difference between the concave and convex portions, is ground and cut by a control method adopted for processing an ordinary lens, backlash develops. Backlash may distort a grinding and cutting shape or cause other problems during the reciprocating motion. Accordingly, a complicated control method and a high-performance control device capable of practicing the method are required.

Additionally, since the X-axis table is required to be shifted at least a distance of a radius of the workpiece, miniaturization of the X-axis table is limited, resulting in a large-size, heavy structure having a large inertial force. It is thus difficult to finely and rapidly reciprocate the workpiece in the X-axis direction; consequently, the X-axis table cannot follow the workpiece when rotated at the same revolution as that adopted for processing an ordinary lens, when the toric or other surface is ground and cut. There is a possibility of the X-axis table rapidly reciprocating by using a motor having extremely large output, but that is not practical. As a result, the revolution of the workpiece is lowered to a level at which the X-axis table can follow it, which decreases productivity.

The present invention has been developed to solve the above problems, among others. It is thus an object of the invention to provide an aspherical surface processing method, an aspherical surface forming method, and an aspherical surface processing apparatus: capable of rapidly grinding and cutting a workpiece, having a large difference between concave and convex portions, by a simple control method using a conventional aspherical surface processing apparatus to produce a high-quality product.

For solving the above object, an aspherical surface processing method according to an embodiment of the present invention comprises a workpiece to be processed rotating around a rotation axis, and a rotational tool movable relative to the workpiece in the same direction as the rotation axis of the workpiece and in a direction perpendicular to the rotation axis of the workpiece. The aspherical surface processing method is wherein the rotational tool is shifted in a fixed direction with a predetermined feed pitch; in a partial or entire region from a center of the rotation axis of the workpiece to a periphery of the workpiece; and in the direction perpendicular to the rotation axis of the workpiece to process the workpiece into a non-axisymmetrical and aspherical surface.

According to the aspherical surface processing method of the invention, since the rotational tool is shifted in a fixed direction with a predetermined pitch to process the workpiece, the rotational tool grinds and cuts the workpiece while forming not a zigzag track but a simple spiral track. More specifically, the rotational tool does not reciprocate but relatively moves in a fixed direction all the time along the direction perpendicular to the rotation axis of the workpiece.

As a result, the X-axis table of the aspherical surface processing apparatus moves the workpiece in a fixed direction without reciprocating it. Thus, the control method over the X-axis table is simplified and a high-performance control device for practicing the method is not required. Additionally, the X-axis table can follow the workpiece, having a large difference between the concave and convex portions, rotated at an increased revolution. Therefore, rapid and high-quality grinding and cutting can be performed by a more simplified control method compared with a conventional method.

Moreover, provided is an aspherical surface processing method wherein the rotational tool is disposed in such a position that a rotation center axis of a tip of the rotational tool is located in a normal direction established at a processing point of the workpiece.

Additionally, provided is an aspherical surface processing method wherein processing by the rotational tool is started from a point where the distance between the rotation center of the workpiece and the tip of the rotational tool in the direction perpendicular to the rotation axis of the workpiece is zero or approximately zero, or a point where the distance between a peripheral edge of the workpiece and the tip of the rotational tool is zero or approximately zero.

Furthermore, provided is an aspherical surface processing method wherein the rotational tool is a whetstone rotating around a rotation axis.

Moreover, provided is an aspherical surface processing method wherein the rotational tool is a cutting tool rotating around a rotation axis.

Additionally, provided is an aspherical surface forming method comprising a roughing step for forming the workpiece in a shape similar to a desired shape, and a finishing step for forming the workpiece in the desired shape by employing the aspherical surface processing methods as set forth above, subsequent to the roughing step.

Furthermore, provided is an aspherical surface processing apparatus in which the aspherical surface forming methods as set forth above are employed.

The present invention is capable of processing an aspherical surface of an optical lens, such as a spectacle lens with high accuracy.

The invention is taught below by way of various specific exemplary embodiments explained in detail, and illustrated in the enclosed drawing figures.

BRIEF DESCRIPTION OF THE DRAWINGS

The drawing figures depict, in highly simplified schematic form, embodiments reflecting the principles of the invention. Many items and details that will be readily understood by one familiar with this field have been omitted so as to avoid obscuring the invention. In the drawings:

FIG. 4A is an elevation view, a plane view, and a side view with each view showing a positional relationship between the workpiece and the rotational tool.

FIG. 8A is a front view of the lens.

FIG. 10A is a front view of the rotational tool.

FIG. 11A is a front view of the rotational tool.

FIG. 12A is a front view of the lens.

DESCRIPTION OF THE PREFERRED EMBODIMENTS

Embodiments of an aspherical surface processing method according to an embodiment of the present invention are hereinafter described. Although the embodiments are described in detail, it will be appreciated that the invention is not limited to just these embodiments, but has a scope that is significantly broader. The appended claims should be consulted to determine the true scope of the invention.

Description of Processing Apparatus

Figure 1:
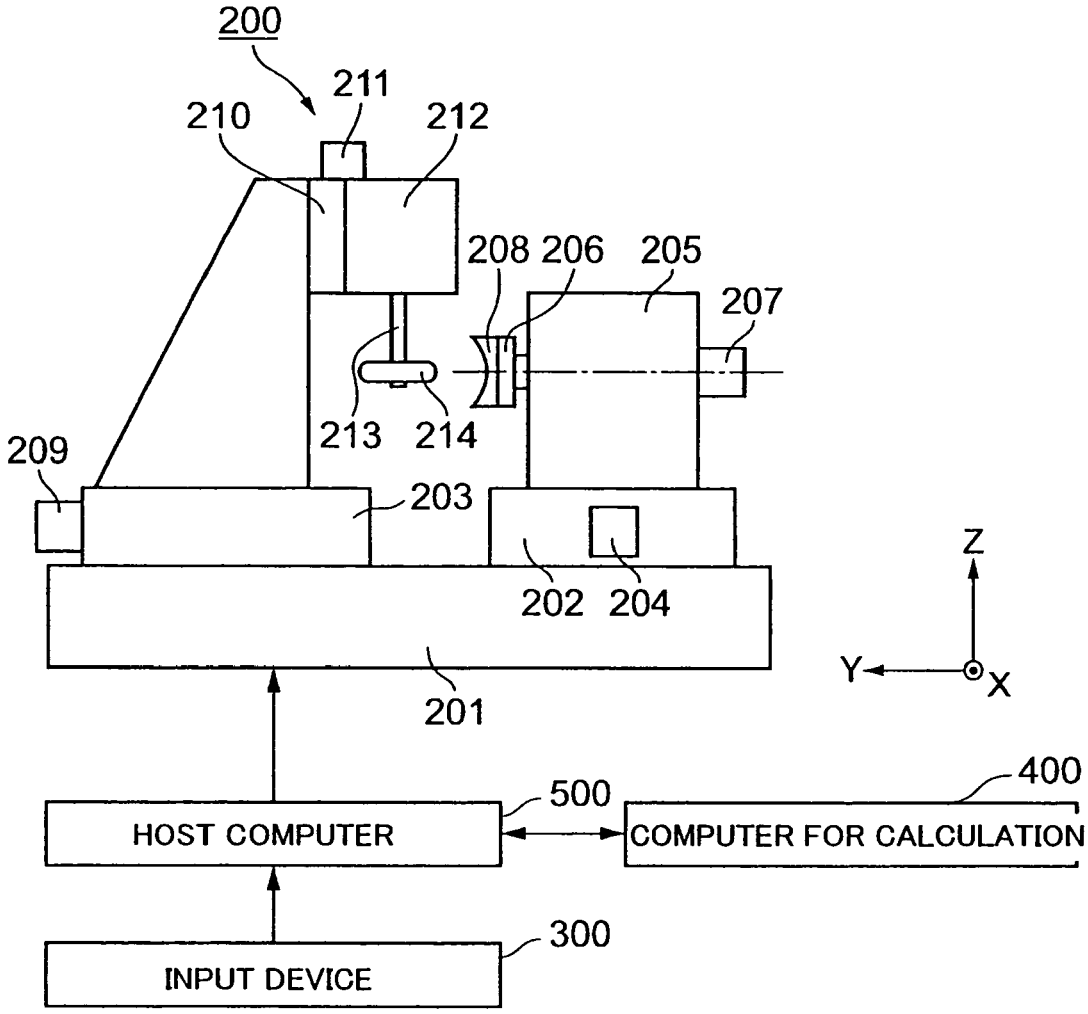
FIG. 1 is an elevation view showing an aspherical surface processing apparatus which employs an aspherical surface processing method in a first embodiment.

Explained herein is an aspherical surface processing apparatus (also referred to as a numerical control apparatus) used for grinding and cutting a spectacle lens, for example, by an aspherical surface processing method of the invention in conjunction with FIG. 1. FIG. 1 is an elevation view showing the aspherical surface processing apparatus 200 used in an aspherical surface processing method of a first embodiment.

The aspherical surface processing apparatus 200 includes an X-axis table 202 and a Y-axis table 203 on a bed 201. The X-axis table 202 is driven by an X-axis driving motor 204 so as to reciprocate in an X-axis direction. A position in the X-axis direction is calculated by a not-shown encoder contained in the X-axis driving motor 204. A workpiece axis rotation unit 205 as a workpiece axis rotating means is fixed on the X-axis table 202. A workpiece chuck 206 is attached to the workpiece axis rotation unit 205 and is rotated around a main shaft as a rotation axis extending in a Y-axis direction perpendicular to the X-axis by means of a workpiece rotation axis driving motor 207. The rotation position of the workpiece chuck 206 is calculated by a not-shown encoder contained in the workpiece rotation axis driving motor 207. A workpiece 208 to be processed (spectacle lens) is attached to the workpiece chuck 206 via a not-shown block jig. The Y-axis table 203 is driven by a Y-axis driving motor 209 so as to reciprocate in the substantially horizontal Y-axis direction which is perpendicular to the X-axis table 202. A position in the Y-axis direction is calculated by a not-shown encoder contained in the Y-axis driving motor 209. A Z-axis table 210 is mounted on the Y-axis table 203. The Z-axis table 210 is driven by a Z-axis driving motor 211 so as to reciprocate in a Z-axis direction. A position in the Z-axis direction is calculated by a not-shown encoder contained in the Z-axis driving motor 211. A rotational tool rotation unit 212 as a rotational tool rotating means is fixed on the Z-axis table 210. A rotational tool 214 is attached to a rotational tool shaft 213 of the rotational tool rotation unit 212 and is rotated around a main shaft as a rotation axis extending in the Z-axis direction perpendicular to the X axis by means of the Z-axis driving motor 211.

In the aspherical surface processing apparatus 200, such a structure may be adopted in which the workpiece axis rotation unit 205 is immobilized and the Y-axis table 203 is mounted on the X-axis table 202 such that the rotational tool 214 can reciprocate in the X-axis direction by the movement of the X-axis table 202, rather than the above-described structure in which the workpiece axis rotation unit 205 is reciprocated in the X-axis direction by driving the X-axis table 202.

Additionally, a linear scale may be employed as means for detecting positions on the X, Y and Z axes in lieu of the encoder.

The control method is now described.

First, the rotation center of the rotational tool 214 in the Z-axis direction calculated by the encoder is positioned at the rotation center of the workpiece 208. Next, the rotation position of the workpiece 208 is calculated by the encoder while rotating the workpiece 208. Then, the position of the rotational tool 214, as the rotation axis of the workpiece 208 calculated by the encoder in the Y-axis direction relative to the position of the workpiece 208, is synchronized with the rotation of the workpiece 208. At the same time, the distance between the rotation center of the rotational tool axis 213 calculated by the encoder in the X-axis direction and the rotation center of the workpiece 208 is synchronized with the rotation of the workpiece 208. As described, the rotational tool 214 is positioned at a processing point using the three axes: the X-axis table 202, the Y-axis table 203, and the workpiece axis rotation unit 205. The lens shape is created in accordance with the lens design shape by successively positioning coordinates of the rotation center of the rotational tool axis 213 corresponding to the processing point.

The numerical value data required for processing the workpiece (spectacle lens) 208 by the aspherical surface processing apparatus 200 is calculated by a computer for calculation 400 based on prescription data on the spectacle lens inputted by an input device 300 as inputting means. The numerical value data is stored in a memory contained in the aspherical surface processing apparatus 200 via a host computer 500 or transmitted during processing from the host computer 500 to the aspherical surface processing apparatus 200.

Description of Grinding and Cutting Procedures

Figure 2:
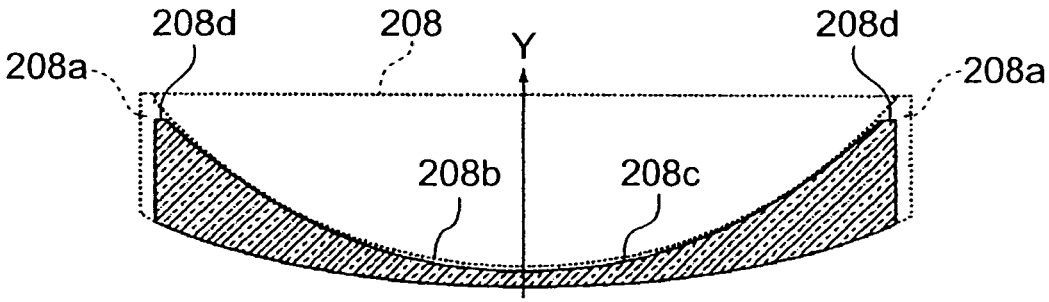
FIG. 2 is a cross-sectional view illustrating a lens as an example of a workpiece.

Grinding and cutting procedures for creating an aspherical surface are herein described with reference to FIG. 2. FIG. 2 is a cross-sectional view of a lens as an example of a workpiece.

The grinding and cutting method involves an outside diameter process, an approximate surface roughing process, a finishing process, a chamfering process and other processes. The outside diameter process cuts off unnecessary peripheral portions 208*a* of the slightly thick workpiece 208 having an after-process margin (grinding margin and cutting margin) as an example of the workpiece 208 (hereinafter referred to as "semifinished lens 208") to reduce its diameter to a predetermined length as shown in FIG. 2. The outside diameter process is also performed for the purpose of shortening the time required for the roughing process and the finishing process. The approximate surface roughing process rapidly cuts the semifinished lens 208 to form a predetermined approximate surface shape 208*b*. The finishing process accurately creates a desired lens surface shape 208*c* by cutting the approximate surface shape 208*b*. The chamfering process chamfers edges 208*d* by means of the rotational tool 214 (for finishing) since the edges of the lens after the finishing process are sharp and dangerous and easy to chip off.

The steps for grinding and cutting the semifinished lens 208 using the aspherical surface processing apparatus 200 shown in FIG. 1 are now described. The semifinished lens 208 fixed by the not-shown block jig is secured to the workpiece chuck 206. The seminifished lens 208 is ground and cut by the rotational tool 214 (for roughing) to a predetermined outside diameter based on outside diameter process data given to the semifinished lens 208. Next, the semifinished lens 208 is further ground and cut by the rotational tool 214 (for roughing) based on approximate surface roughing process data to the approximate surface shape 208*b*. The surface shape 208*b* can be a surface in the shape of a free curve surface, a toric surface, or a spherical surface similar to the desired lens surface shape 208*c* with surface roughness Rmax of 100 μm or smaller. Subsequently, the semifinished lens 208 having the approximate surface shape 208*b* is further ground and cut by an amount from about 0.1 mm to about 5.0 mm by the rotational tool 214 (for finishing) based on finishing process data to the lens surface shape 208*c* in accordance with the prescription data of the spectacle lens with surface roughness Rmax from about 1 μm to about 10 μm. Then, the chamfering process is performed using the rotational tool 214 (for finishing) based on chamfering process data to chamfer the edges 208*d*.

Description of Grinding and Cutting Requirements

The grinding and cutting requirements are established in the following ranges.

Grinding

Rotational tool: whetstone.

Bond type: metal, resin.

Revolution of workpiece: 1 through 300 rpm for the roughing process, and 1 through 300 rpm for the finishing process.

Feed pitch: 0.05 through 5.0 mm/rev. for the roughing process, and 0.005 through 1.0 mm/rev. for the finishing process.

Cutting amount: 0.1 through 5.0 mm/pass for the roughing process, and 0.001 through 0.5 mm/pass for the finishing process (depending on the mesh of the whetstone).

Cutting

Rotational tool: cutter.

Material: monocrystal or polycrystal diamond.

Revolution of workpiece: 1 through 300 rpm for the roughing process, and 1 through 300 rpm for the finishing process.

Feed pitch: 0.05 through 5.0 mm/rev. for the roughing process, and 0.005 through 1.0 mm/rev. for the finishing process.

Cutting amount: 0.1 through 10.00 mm/pass for the roughing process, and 0.005 through 3.0 mm/pass for the finishing process.

The process is performed with a constant feed pitch in most cases, but the feed pitch may be varied during processing. For example, when an astigmatic-power lens has 2.00 D or larger, the periphery of the lens often chips regardless of the refractive index of the lens. For processing such a lens, the outer periphery of the lens is processed with a small feed pitch P1, and the inner periphery of the lens adjacent to the lens center is processed with a large feed pitch P0 (P1<P0). More specifically, P1 is determined in a range from 0.01 mm/rev. to 0.07 mm/rev., while P0 is determined in a range from 0.03 mm/rev. to 0.10 mm/rev. The outer periphery of the lens to be processed with the feed pitch P1 ranges 5 mm to 15 mm from the farthest periphery of the lens.

Embodiment 1

Figure 3A:
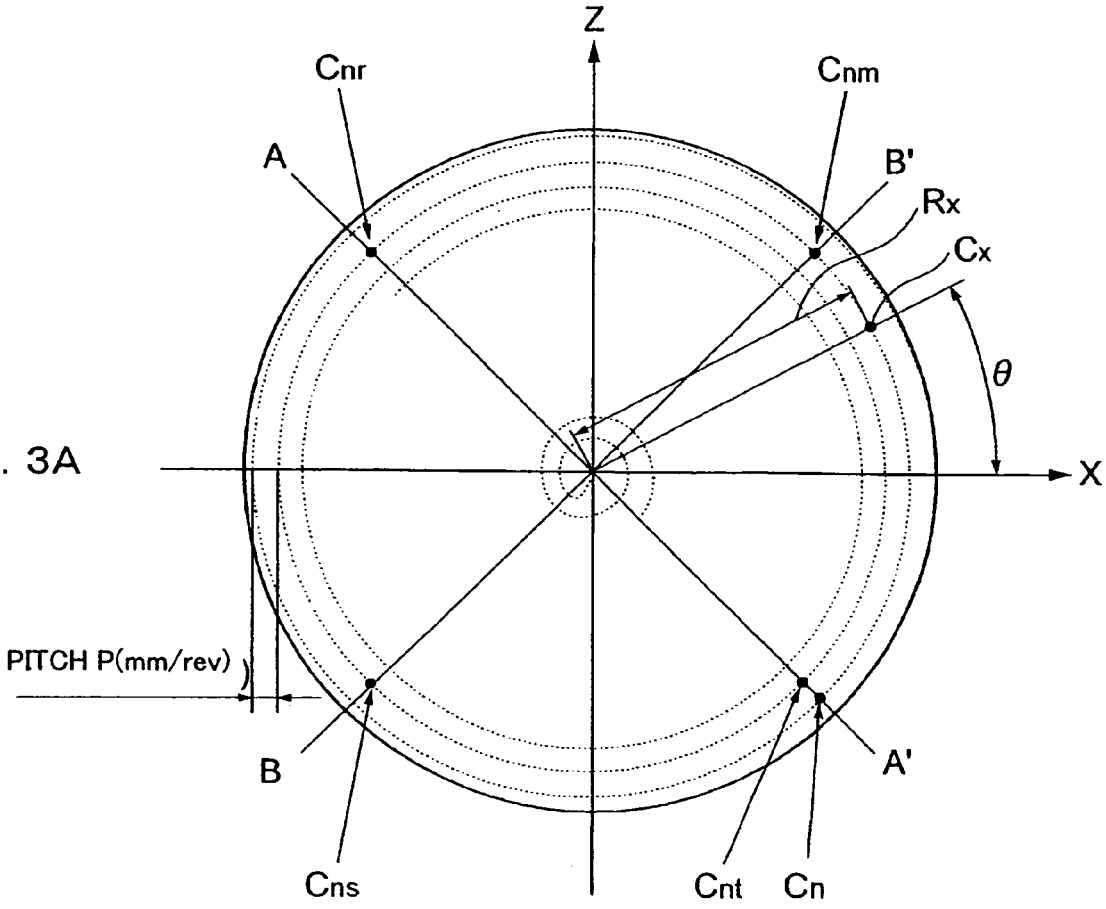
FIG. 3A is a schematic view illustrating a processed surface of a lens in the aspherical surface processing method and is a front view of the lens.
Figure 3B:
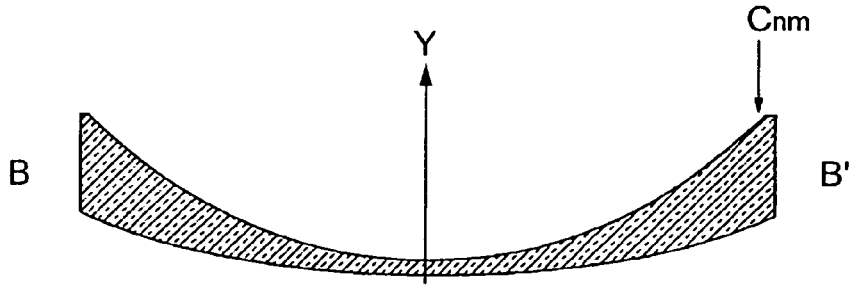
FIG. 3B is a cross-sectional view of the lens taken along a line B–B' in FIG. 3A.
Figure 4A:
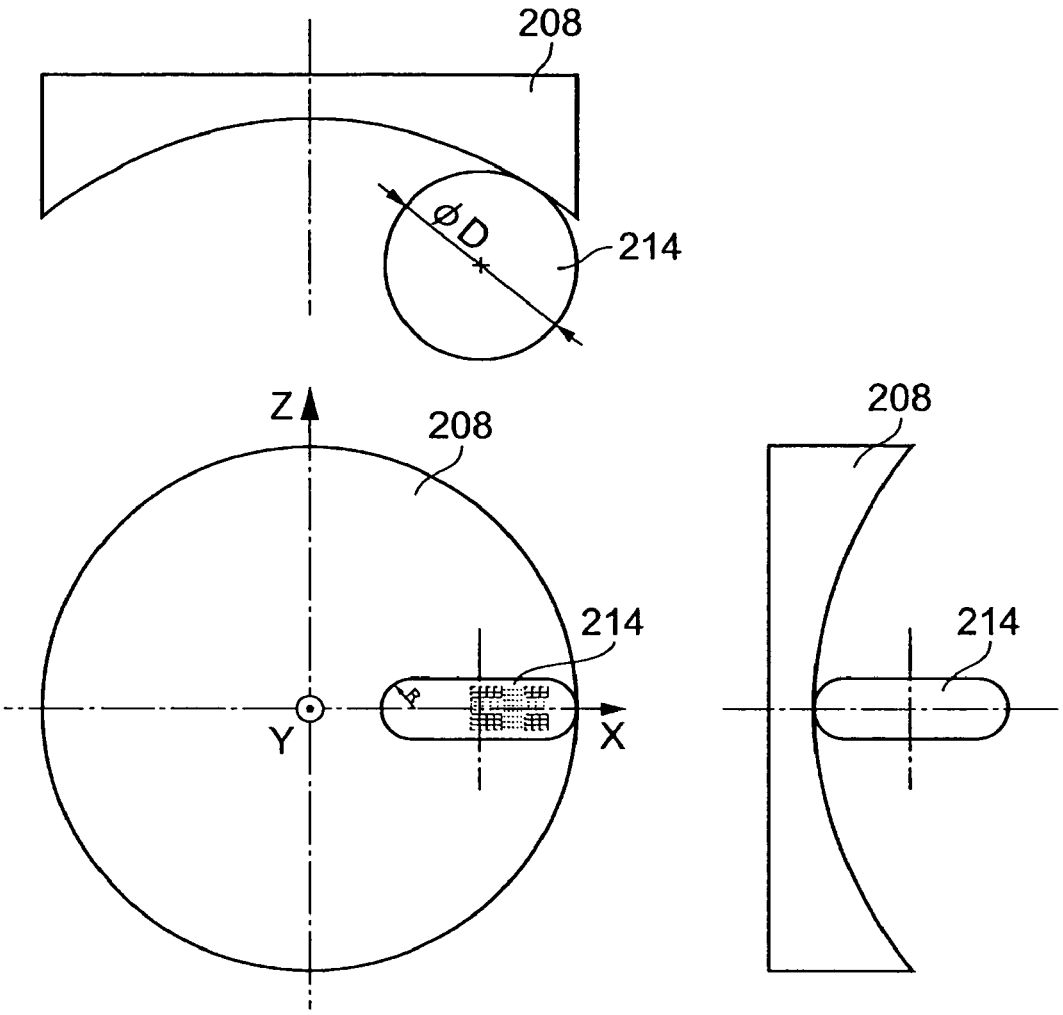
FIG. 4A is a conceptual view showing three-dimensional coordinates of a tip surface of a rotational tool divided in a grid pattern.
Figure 4B:
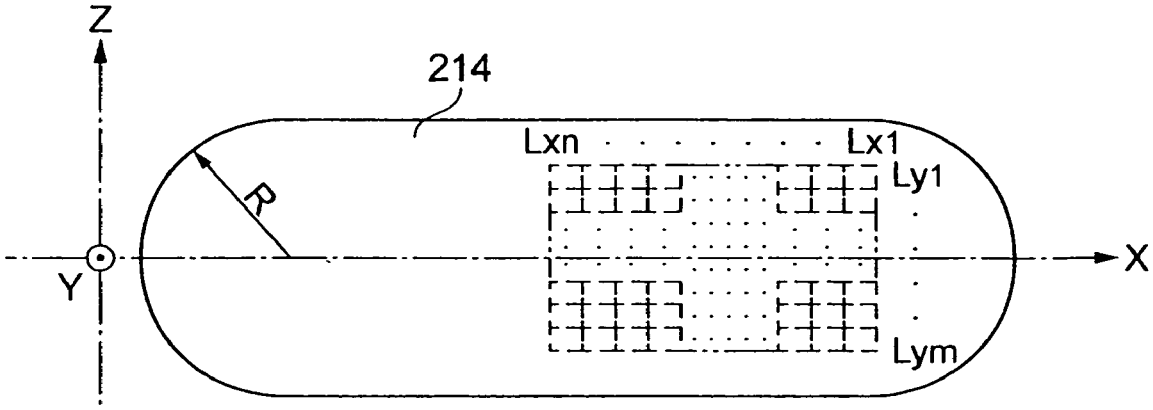
FIG. 4B is an enlarged view of the rotational tool shown in FIG. 4A.
Figure 5:
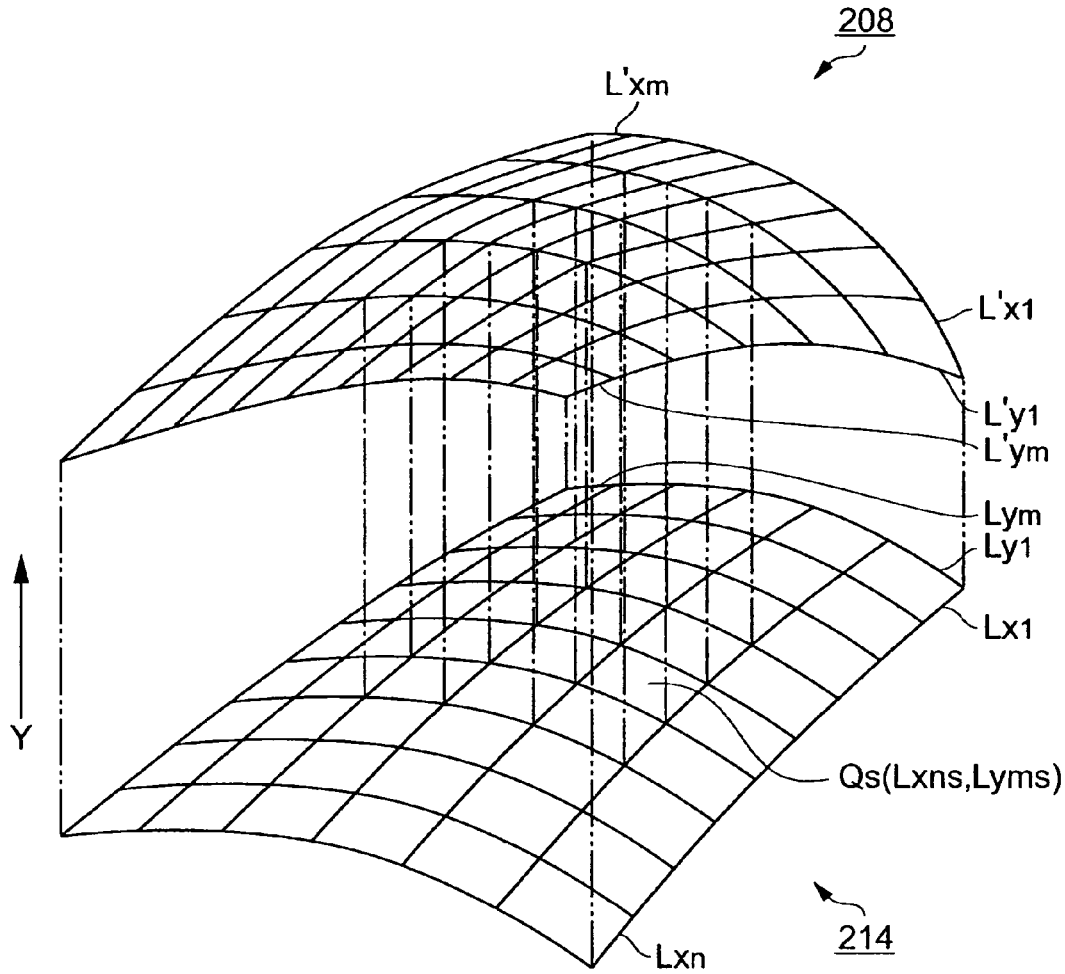
FIG. 5 is a conceptual view illustrating three-dimensional coordinates on a surface of the workpiece and a surface of the rotational tool tip.
Figure 6:
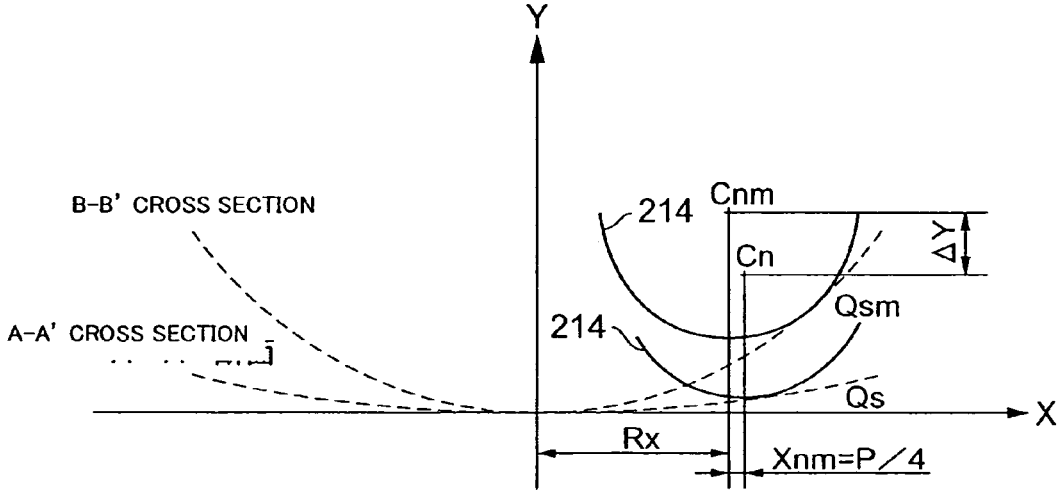
FIG. 6 is a conceptual view showing the aspherical surface processing method.
Figure 7:
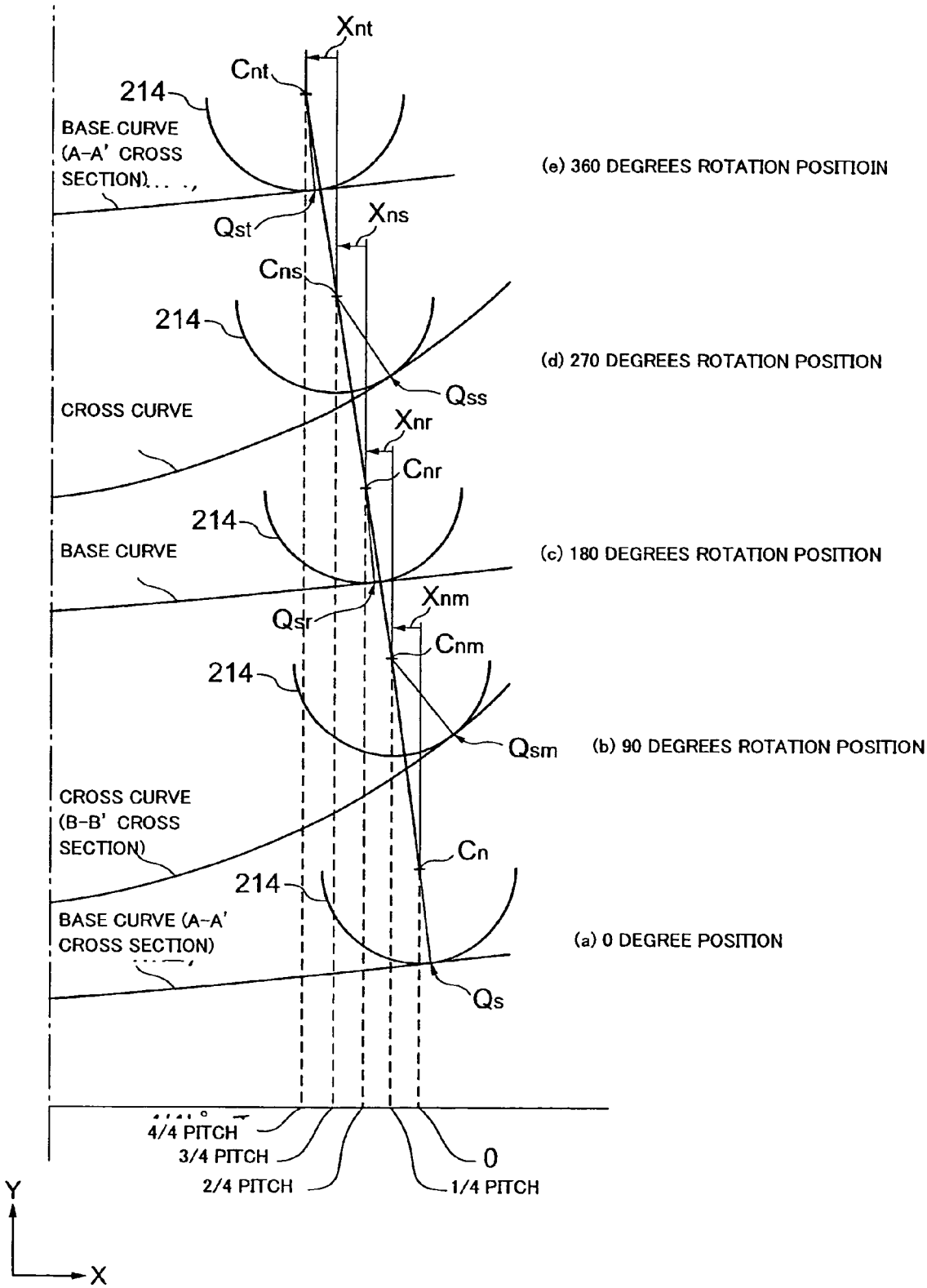
FIG. 7 is a conceptual view showing a center position of the rotational tool in an X-axis direction in the aspherical surface processing method.

The first embodiment of the aspherical surface processing method according to an embodiment of the present invention for processing a spectacle lens (hereinafter referred to as "lens"), for example, is described in conjunction with FIGS. 3A, 3B, 4A, 4B, 5, 6 and 7. FIG. 3A is a schematic view illustrating a processed surface of the lens in the aspherical surface processing method. FIG. 3A is a front surface of the lens, while FIG. 3B is a cross-sectional view of the lens taken along a line B–B' in FIG. 3A. FIG. 4A is a conceptual view illustrating three-dimensional coordinates of a tip surface of a rotational tool divided in a grid pattern. FIG. 4A is an elevation view, a plane view, and a side view with each showing a positional relationship between the workpiece and the rotational tool, while FIG. 4B is an enlarged view of the rotational tool shown in FIG. 4A. FIG. 5 is a conceptual view illustrating three-dimensional coordinates on a surface of the workpiece and a surface of the rotational tool tip. FIG. 6 is a conceptual view showing the aspherical surface processing method. FIG. 7 is a conceptual view showing a center position of the rotational tool in an X-axis direction in the aspherical surface processing method.

In the aspherical surface processing method of the first embodiment, the whetstone of the rotational tool 214 grinds with the rotation center of the rotational tool axis 213 forming a spiral track as illustrated in FIG. 3A. In a conventional normal control method, processing points shown by rotation angles of a lens and distances from a rotation center are determined in advance. However, in the aspherical surface processing method of the first embodiment, a spiral shape formed by the rotation center position of the rotational tool axis 213 is determined in advance. More specifically, the spiral track formed by the rotation center of the rotational tool axis 213 is established by a predetermined feed pitch in a direction perpendicular to the rotation axis of the workpiece 208 (X-axis). In this embodiment, a spiral shape is formed when a distance from the rotation center of the workpiece 208 to the rotation center of the rotational tool axis 213 (Rx) is successively decreased with a predetermined feed pitch. This occurs when the rotation center of the rotational tool axis 213 travels from the periphery of the lens toward the center.

Additionally, in the aspherical surface processing method of the first embodiment, the numerical value data of coordinates Cx of the rotation axis center of the rotational tool axis 213 can be shown by three points (Θ, Rx, y) in which: (Θ) is a rotation position of the workpiece 208; (Rx) is a distance from the rotation center of the workpiece 208 which distance is successively decreased with a predetermined feed pitch in a direction perpendicular to the rotation axis of the workpiece 208 (X-axis); and (y) is a position at which the tip of the rotational tool 214 contacts the processing point of the workpiece 208 in the same direction as the not-shown rotation axis of the workpiece 208 (Y-axis). The lens shape in accordance with the lens design shape is created by successively positioning the rotation axis center coordinates of the rotational tool axis 213. The numerical value data for processing may be constituted by coordinates which are absolute values of each point or values relative to one point prior to that point.

As illustrated in FIG. 4B, three-dimensional coordinates of a grid point are found, which point is disposed at a predetermined position of a surface of the tip of the rotational tool 214 having a radius R in a round shape, with the surface being divided in a grid pattern according to a predetermined rule.

Additionally, as illustrated in FIG. 5, the three-dimensional coordinates of the surface of the tip of the rotational tool 214 are transferred along the direction toward the origin of the Y-axis onto the surface of the workpiece 208 to find three-dimensional coordinates of the surface of the workpiece 208 divided in a grid pattern according to the same predetermined rule as that of the surface of the rotational tool 214.

Thereafter, the distance between the surface of the workpiece 208 and the surface of the rotational tool 214 is calculated for each grid point corresponding to the three-dimensional coordinates of the surface of the workpiece 208 and to the three-dimensional coordinates of the surface of the rotational tool 214 to find a combination of grid points at which the distance between the grid points is minimized. The coordinates of the grid points (Lxn, Lym) coincide with the contact point.

When a side of the grid is elongated, the accuracy of finding a processing point is lowered. Conversely, when a side of the grid is shortened, the accuracy is improved but a longer time is required for the calculation. Practically, the length of the side is in a range from about 0.001 mm to about 0.1 mm.

A conceptual view of the aspherical surface processing method is shown in FIGS. 6 and 7, when the center axis of the tip of the rotational tool 214 (hereinafter referred to as "tip center axis") is in a direction perpendicular to the rotation axis of the workpiece 208 (X axis) and is located at an arbitrary point Cn of a portion having the minimum thickness (base curve, A–A' cross section). Then, the tip center axis of the rotational tool 214 in the Y-axis direction is disposed in such a position that a contact point (processing point) coincides with a point Qs ($Lxn_s$, $Lym_s$), where the grid point corresponding to the three-dimensional coordinates of the surface of the tip of the rotational tool 214 and the grid point corresponding to the three-dimensional coordinates of the surface of the workpiece 208 are first brought into contact with each other by freely moving the rotational tool 214 in the Y-axis direction as illustrated in FIG. 5. The tip center axis of the rotational tool 214 is positioned on a normal established at the point Qs as illustrated in FIGS. 6 and 7.

When the lens is rotated 90 degrees and the rotation center axis of the tip of the rotational tool 214 is shifted from the point Cn to an arbitrary point Cnm of a portion having the maximum thickness (cross curve, B–B' cross section), the tip center axis of the rotational tool 214 in the Y-axis direction is positioned on a normal established at a point Qsm (contact point). At the point Qsm, the grid point corresponding to the three-dimensional coordinates of the surface of the tip of the rotational tool 214 and the grid point corresponding to the three-dimensional coordinates of the surface of the workpiece 208 are first brought into contact with each other, by freely moving the rotational tool 214 in the Y-axis direction. When the lens is rotated 90 degrees and the rotational tool 214 is shifted from the point Cn to the point Cnm, the rotational tool 214 moves by an amount of AY in the plus direction of the Y-axis and relatively moves by an amount of Xnm, which is accurately equal to a quarter of a pitch, toward the center of the X-axis. That is, the workpiece 208 is shifted by the amount of Xnm which is accurately equal to a quarter of a pitch outward in the X-axis direction by the X-axis table 202.

When the lens is rotated further 90 degrees and the center of the tip of the rotational tool 214 is shifted from the point Cnm to an arbitrary point Cnr of the portion having the minimum thickness, the rotational tool 214 moves in the minus direction of the Y-axis and relatively moves by an amount of Xnr, which is accurately equal to a quarter of a pitch, to the center of the X-axis direction. That is, the workpiece 208 is shifted by the amount of Xnr which is accurately equal to a quarter of a pitch outward in the X-axis direction by the X-axis table 202.

In the aspherical surface processing method of the first embodiment, the X-axis table 202 of the aspherical surface processing apparatus 200 does not reciprocate the workpiece (lens) 208. But, instead, it moves the workpiece (lens) 208 in a fixed direction by successively decreasing the distance Rx between the rotation center of the workpiece 208 and the tip center axis of the rotational tool 214 in the direction perpendicular to the rotation axis of the workpiece 208 (X-axis) with a predetermined feed pitch. When the revolution of the workpiece 208 and the feed pitch are kept constant, the X-axis table 202 moves at a constant speed. As a result, the track formed on the workpiece(lens) 208 by the rotational tool 214 is not a zigzag shape as in a conventional method but a simple spiral shape, and thus the X-axis table 202 can follow the workpiece 208 having a large difference between the concave and convex portions even when the revolution speed of the workpiece 208 is increased. In other words, grinding at a higher grinding speed is allowed.

The aspherical surface processing method of the first embodiment offers about 1.3 times higher productivity than that of a conventional normal control processing method.

As described above in detail, the following advantages can be provided in this embodiment.

According to the aspherical surface processing method, the aspherical surface forming method, and the aspherical surface processing apparatus of the present invention, the table having a large inertial force is not reciprocated but moved in a fixed direction, therefore requiring only simple control over the table. Accordingly, the table can sufficiently follow the workpiece, and the workpiece 208 having a large difference between the concave and convex portions can be rotated at high speeds to be rapidly processed into a high-quality product.

Embodiment 2

Figure 8A:
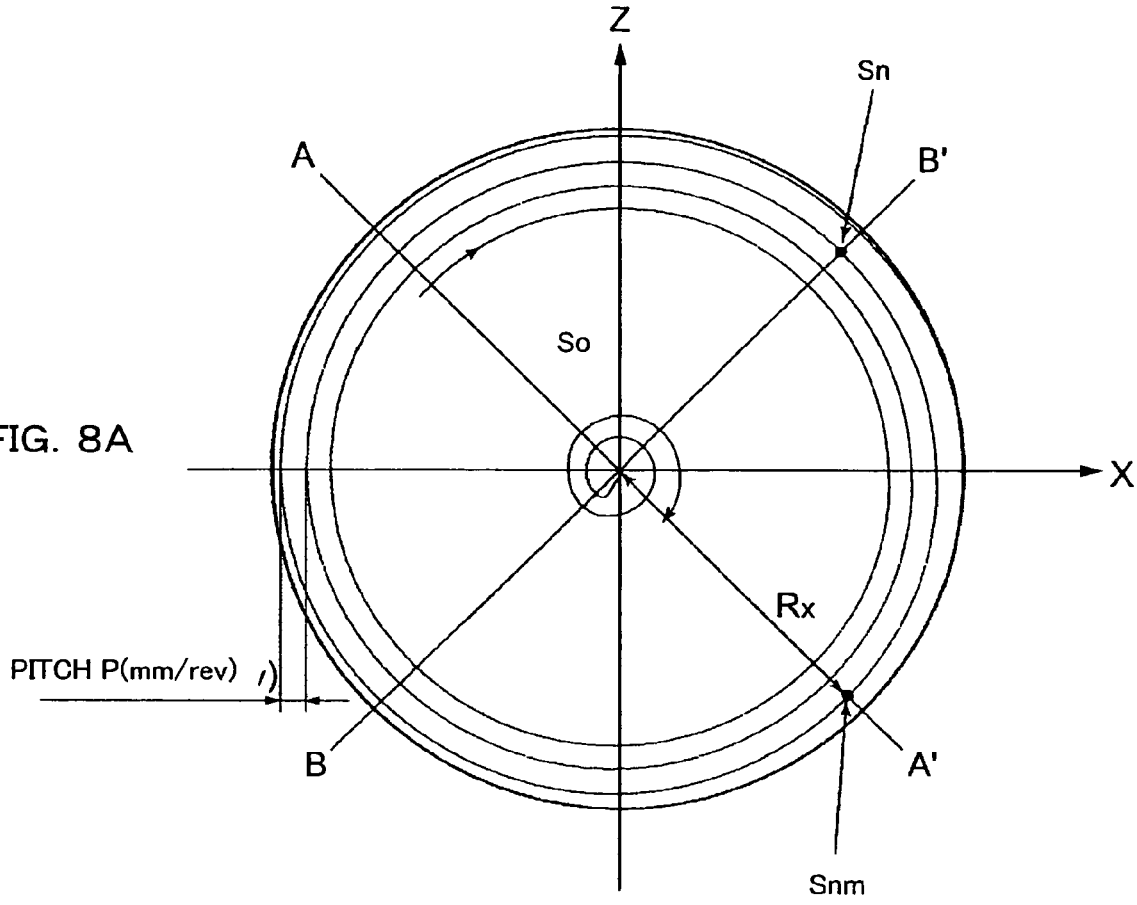
FIG. 8A is a schematic view illustrating a processed surface of a lens in an aspherical surface processing method according to a second embodiment, where
Figure 8B:
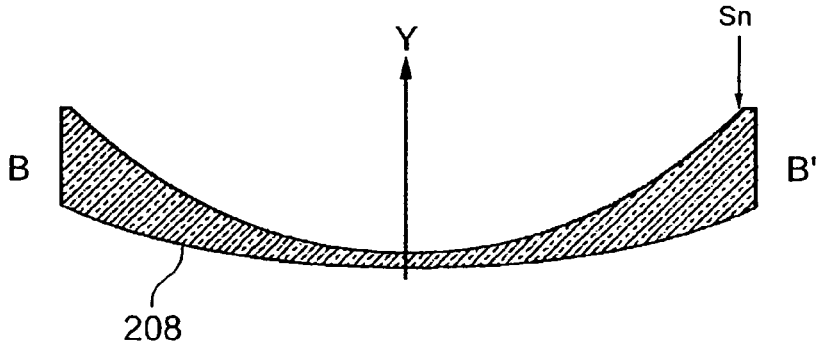
FIG. 8B is a cross-sectional view of the lens taken along a line B–B' in FIG. 8A.
Figure 9:
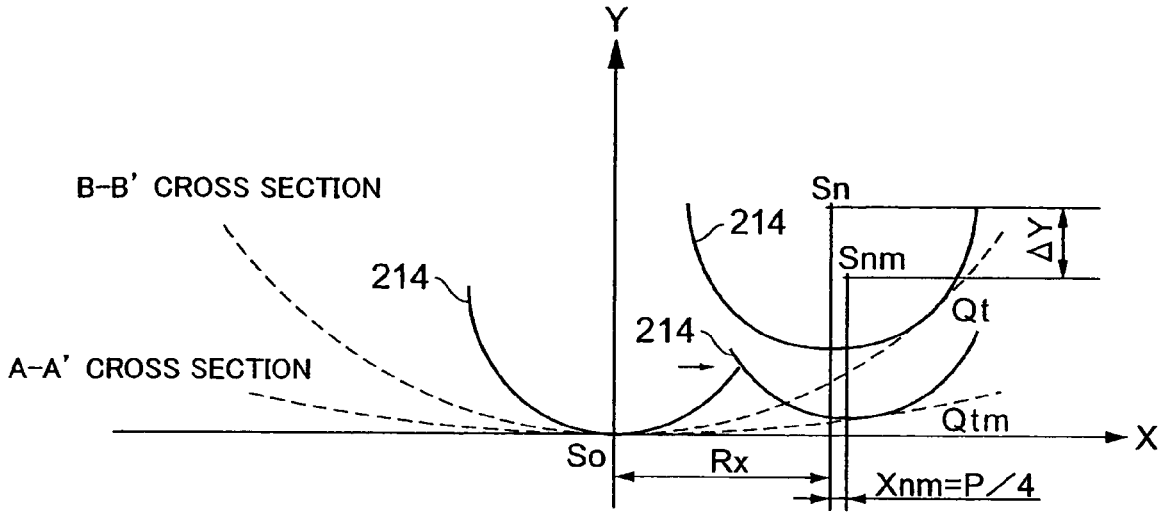
FIG. 9 is a conceptual view showing the aspherical surface processing method.

An aspherical surface processing method of a second embodiment according to the present invention is herein described in conjunction with FIGS. 8A, 8B, and 9. FIG. 8A is a schematic view illustrating a processed surface of a lens in an aspherical surface processing method according to a second embodiment. FIG. 8A is a front view of the lens, while FIG. 8B is a cross-sectional view of the lens taken along a line B–B' in FIG. 8A. FIG. 9 is a conceptual view illustrating the aspherical surface processing method.

In the aspherical surface processing method of the second embodiment, the whetstone of the rotational tool 214 grinds while forming a spiral track as illustrated in FIG. 8. In this embodiment, the distance from the rotation center of the workpiece 208 to the tip center axis of the rotational tool 214 (Rx) is increased with a predetermined feed pitch. More specifically, the grinding is started at a processing point located at or adjacent to the rotation center of the workpiece 208 and is shifted toward the periphery of the workpiece 208. The grinding process data is created along a spiral which extends from the rotation center of the workpiece 208 toward the periphery of the workpiece 208.

In the aspherical surface processing method of the second embodiment, the numerical value data for coordinates of the tip center axis of the rotational tool 214 is shown by the distance from the rotation center of the workpiece 208 (Rx), which is increased with a predetermined feed pitch in a direction perpendicular to the rotation axis of the workpiece 208 (X-axis), instead of the distance Rx described in the first embodiment.

As illustrated in FIGS. 8A and 9, the tip center axis of the rotational tool 214 is positioned in the normal direction, established at a processing point So, and located at the rotation center of the workpiece 208 which direction is shown by the Y-axis (main axis) at the start of the grinding in the aspherical surface processing method of the second embodiment. The process is started from the processing point So positioned at the rotation center of the workpiece 208. For example, when the tip center axis of the rotational tool 214 is positioned at an arbitrary point Sn of a portion having the maximum thickness (cross curve, B–B' cross section), the tip center axis of the rotational tool 214 in the Y-axis direction is disposed on a normal established at a point Qt (contact point). The point Qt is where the grid point corresponding to the three-dimensional coordinates of the surface of the tip of the rotational tool 214 and the grid point corresponding to the three-dimensional coordinates of the surface of the tip of the workpiece 208 are first brought into contact with each other by freely moving the rotational tool 214 in the Y-axis direction.

When the lens 208 is rotated 90 degrees and the tip center axis of the rotational tool 214 is shifted from the point Sn to an arbitrary point Snm of a portion having the minimum thickness (base curve, A–A' cross section), the tip center axis of the rotational tool 214 in the Y-axis direction is disposed in such a position that the grid point corresponding to the three-dimensional coordinates of the surface of the tip of the rotational tool 214 and the grid point corresponding to the three-dimensional coordinates of the surface of the tip of the workpiece 208 are first brought into contact with each other by freely moving the rotational tool 214 in the Y-axis direction. A processing point coincides with a point Qtm (contact point) where the grid point corresponding to the three-dimensional coordinates of the surface of the tip of the rotational tool 214 and the grid point corresponding to the three-dimensional coordinates of the surface of the tip of the workpiece 208 first contact each other. When the lens 208 is rotated 90 degrees and the rotational tool 214 is shifted from the point Sn to the point Snm, the rotational tool 214 moves by an amount of AY in the minus direction of the Y-axis and relatively moves by an amount of Xnm, which is accurately equal to a quarter of a pitch, toward the periphery of the lens 208 in the X-axis direction. That is, the workpiece 208 is shifted by the amount of Xnm which is accurately equal to a quarter of a pitch to the center in the X-axis direction by the X-axis table 202.

In the aspherical surface processing method of the second embodiment as described above, the track formed on the lens 208 by the rotational tool 214 is not a zigzag shape as in a conventional method but a simple spiral shape. The simple spiral shape is formed by increasing the distance Rx between the rotation center of the workpiece 208 in the direction perpendicular to the rotation axis of the workpiece 208 (X-axis) and the tip center axis of the rotational tool 214 with a predetermined feed pitch.

When the rotational tool 214 is applied to a particularly high-speed peripheral surface of the workpiece 208 rotating at high speed to start the grinding process from the periphery of the workpiece 208, the rotational tool 214 cannot immediately contact the peripheral surface of the workpiece 208. It is thus necessary to dispose the rotational tool 214 at a position slightly outward and separated from the peripheral surface of the workpiece 208 and subsequently to shift the rotational tool 214 slowly to the rotation center with a feed pitch for normal grinding before applying the rotational tool 214 to the peripheral surface to start the grinding. The rotational tool 214 is generally shifted about 5 mm outward from the peripheral surface of the workpiece 208, and this period is a dead time for production during which the rotational tool 214 does not grind.

In the aspherical surface processing method of the second embodiment, since the grinding is started from the rotation center of the workpiece 208, the rotational tool 214 is first applied to the rotation center or a portion adjacent to the rotation center of the workpiece 208 whose peripheral speed is zero or almost zero. Accordingly, the rotational tool 214 can contact the workpiece 208 immediately and is thus required to be shifted only in a region in need for grinding to complete the processing.

As described above, the time required for grinding, which is started from the rotation center or a portion adjacent to the rotation center of the workpiece 208, is shorter than the time required for grinding, which is started from the peripheral surface of the workpiece 208. This is because the rotational tool 214 is shifted only in a region requiring grinding without decreasing the speed of the rotational tool 214 as in the former case.

The grinding process data for the grinding process is required to correspond only to the processed surface of the workpiece 208, which reduces the volume of the grinding process data.

It is desirable to apply the aspherical surface processing method in which the grinding is started from the rotation center of the workpiece 208 to a finishing process in the processing procedures described later, since the grinding begins at the rotation center whose peripheral speed is zero or almost zero. It is also possible to start grinding by directly applying the rotational tool 214 to the rotation center of the workpiece 208 when the grinding amount (depth of cut) is in a range from about 0.1 mm to about 5.0 mm.

Additionally, at the start of the grinding, the center axis of the round portion of the tip of the rotational tool 214 is positioned on the Y-axis (main axis) passing the processing point So on the track of the rotation center of the workpiece 208. The position of the rotational tool 214 in the Y-axis direction is determined such that the lens processing point with which the rotational tool 214 contacts in this condition can be processed. The lens shape is created in accordance with the lens design shape by successively positioning the coordinates of the tip center axis of the rotational tool 214 along the spiral track which extends from the rotation center of the workpiece 208 toward the outside. The numerical value data for processing may be constituted by coordinates which are absolute values of each point or values relative to one point prior to that point.

As mentioned, more rapid processing can be attained by the aspherical surface processing method of the second embodiment than in the first embodiment.

As described above in detail, the following advantages can be offered in this embodiment.

According to the aspherical surface processing method, the aspherical surface forming method, and the aspherical surface processing apparatus of the invention, the table having a large inertial force is not reciprocated but moved in a fixed direction, thus requiring only simple control over the table. Accordingly, the table can sufficiently follow the workpiece, and the workpiece 208 having a large difference between the concave and convex portions can be rotated at high speeds to be rapidly processed into a high-quality product.

Embodiment 3

Figure 10A:
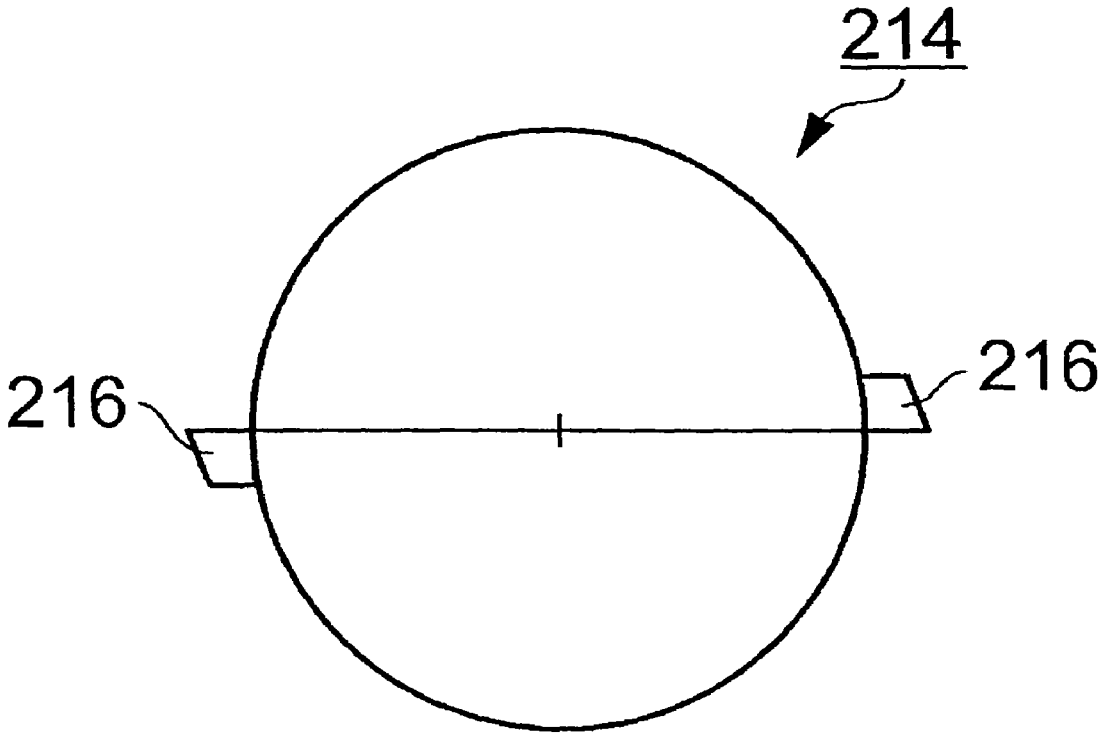
FIG. 10A is a schematic view illustrating a rotational tool in an aspherical surface processing method according to a third embodiment, where
Figure 10B:
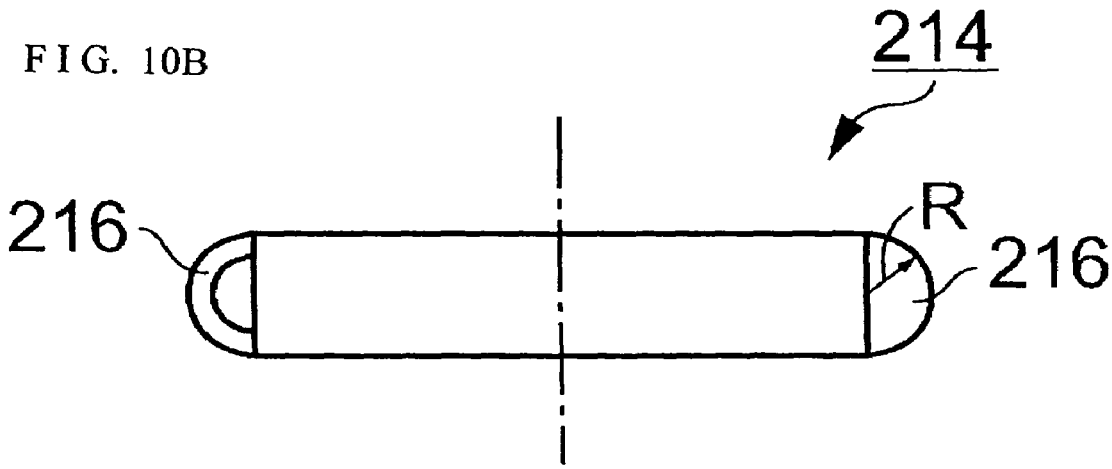
FIG. 10B is a side view of the rotational tool shown in FIG. 10A.

An aspherical surface processing method of a third embodiment of the present invention is now described with reference to FIGS. 10A and 10B. FIG. 10A is a schematic view illustrating a rotational tool 214 in the aspherical surface processing method of the third embodiment. FIG. 10A is a front view of the rotational tool 214, while FIG. 10B is a side view of the rotational tool 214.

In the aspherical surface processing method of the third embodiment, a pair of cutters 216 as cutting tools each of which is provided on a circumference side of the rotational tool 214 are opposed to each other with its center interposed between the cutters 216.

Additionally, the aspherical surface processing method of the third embodiment is similar to the grinding method in which the rotational tool 214 uses a whetstone as described in the above first and second embodiments.

According to this embodiment as explained above in detail, advantages similar to those shown in the first and second embodiments are provided even in an example of the cutting process.

Embodiment 4

Figure 11A:
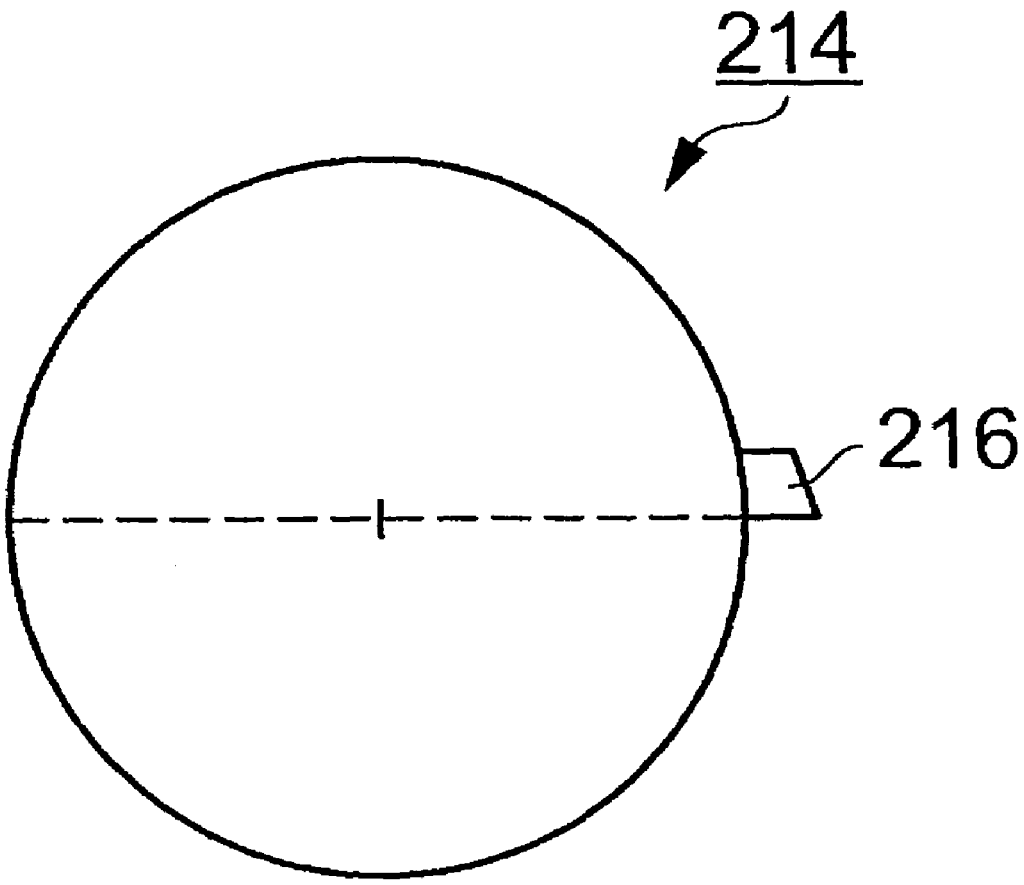
FIG. 11A is a schematic view illustrating a rotational tool in an aspherical surface processing method according to a fourth embodiment, where
Figure 11B:
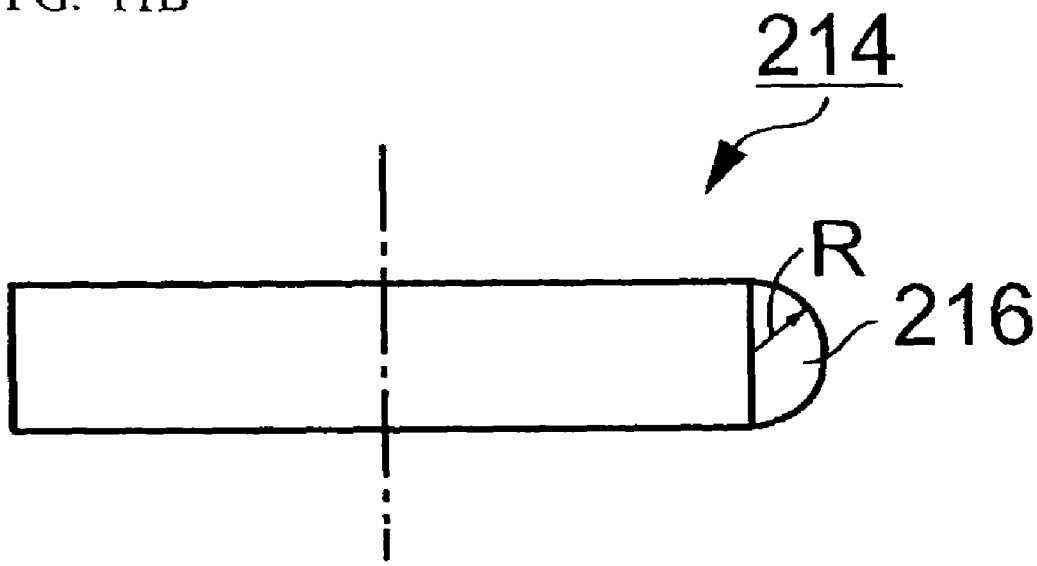
FIG. 11B is a side view of the rotational tool.
Figure 12A:
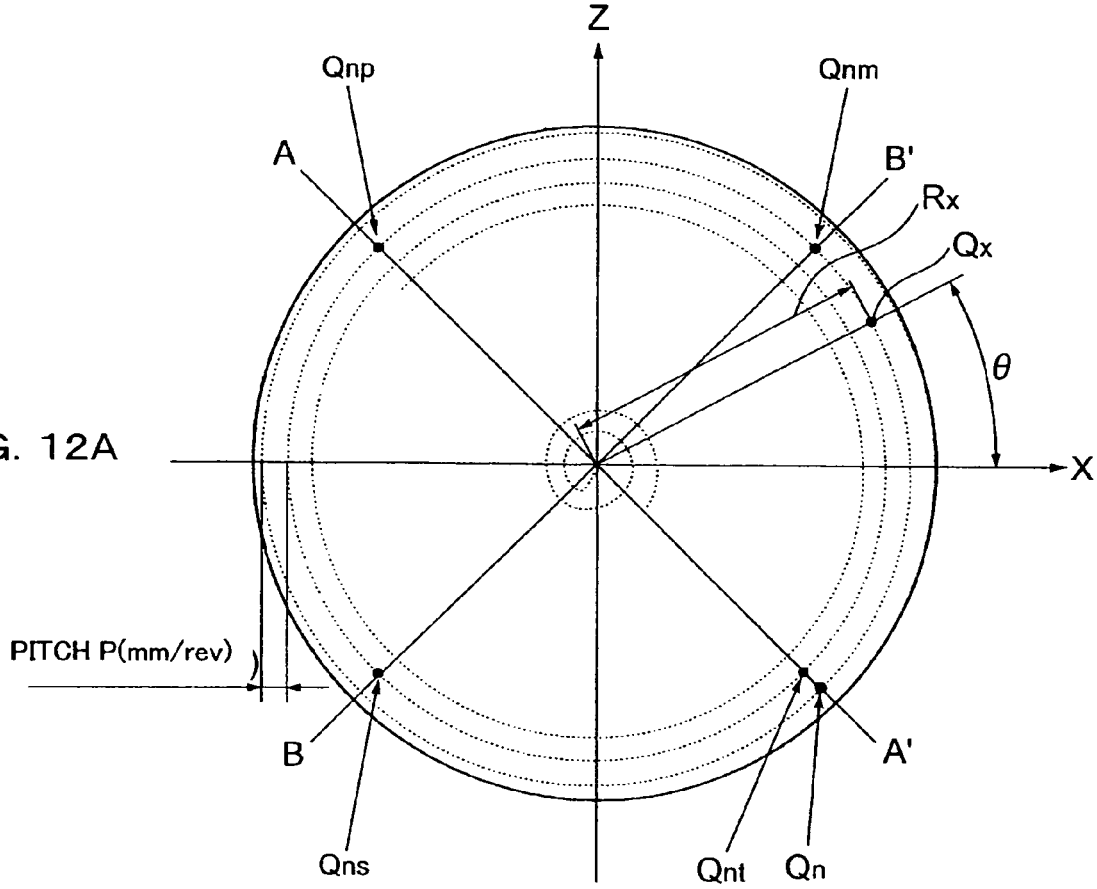
FIG. 12A is a schematic view illustrating a processed surface of a lens in a normal control processing method as a conventional example.
Figure 12B:
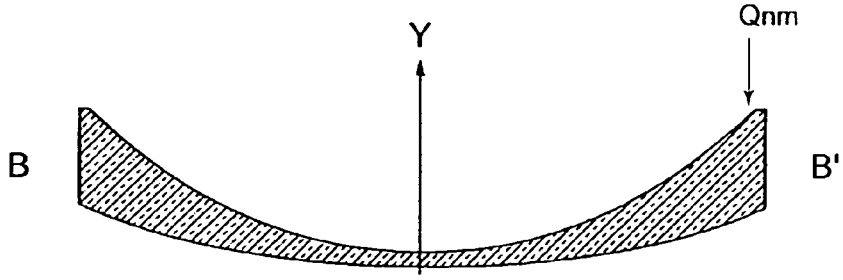
FIG. 12B is a cross-sectional view of the lens taken along a line B–B' in FIG. 12A.
Figure 13:
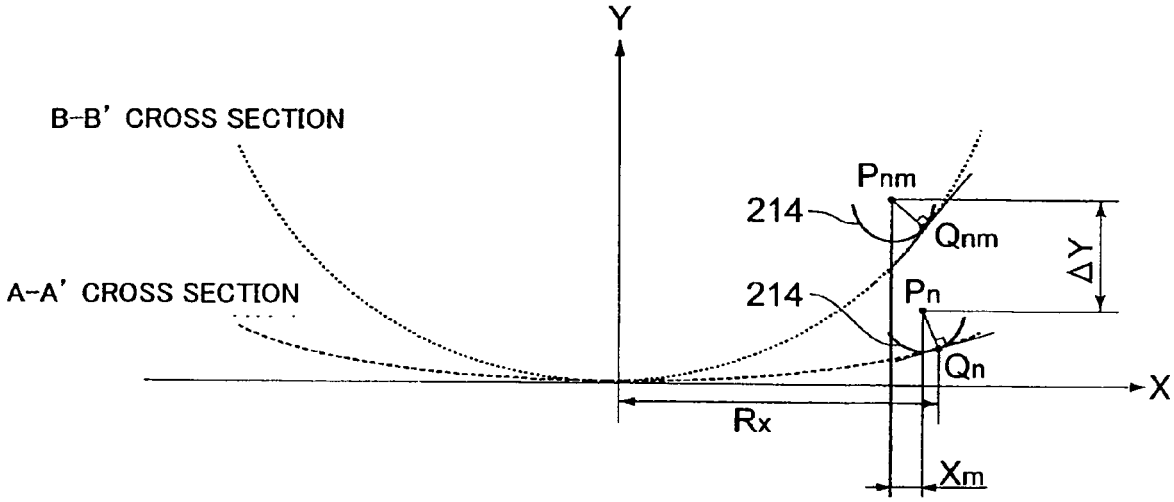
FIG. 13 is a conceptual view showing the normal control processing method.
Figure 14:
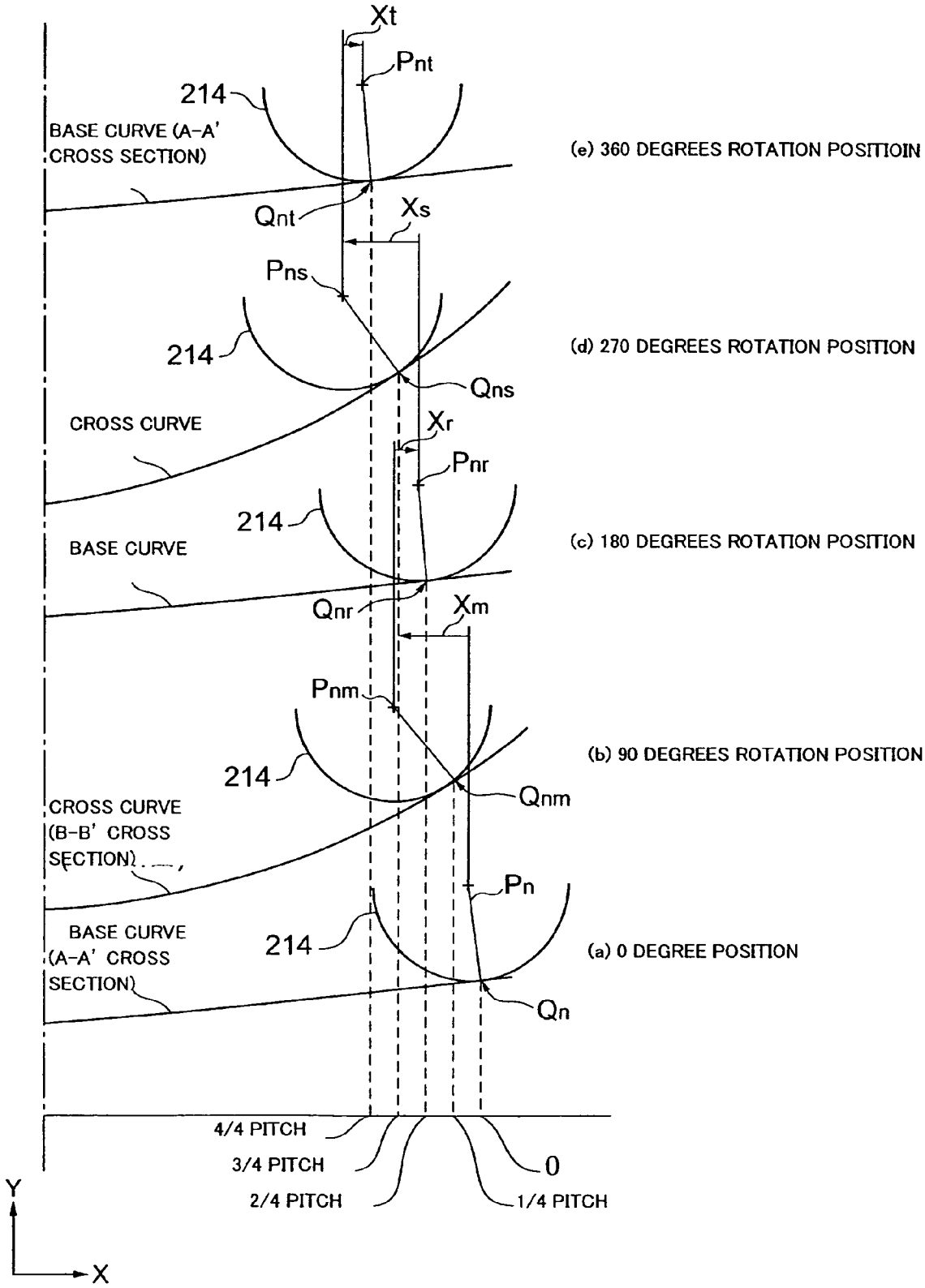
FIG. 14 is a conceptual view showing a center position of a rotational tool in an X-axis direction in the normal control processing method.

An aspherical surface processing method of a fourth embodiment of the present invention is now described with reference to FIGS. 11A and 11B. FIG. 11A is a schematic view illustrating a rotational tool 214 in the aspherical surface processing method of the fourth embodiment. FIG. 11A is a front view of the rotational tool 214, while FIG. 11B is a side view of the rotational tool 214.

In the aspherical surface processing method of the fourth embodiment, a cutter 216 is provided on a circumference side of the rotational tool 214.

Additionally, the aspherical surface processing method of the fourth embodiment is similar to the grinding method in which the rotational tool 214 uses a whetstone as described in the above first and second embodiments.

According to this embodiment as explained above in detail, advantages similar to those shown in the third embodiment are provided even in an example of the single cutter 216 equipped on the rotational tool 214.

Many variations to the above-identified embodiments are possible without departing from the scope and spirit of the invention. Possible variations have been presented throughout the foregoing discussion. Moreover, it will be appreciated that the present invention is not limited to the above-described examples. For example, the following points may be adopted:

(1) The aspherical surface processing method of the present invention may be employed for processing the entire lens 208. Alternatively, the lens 208 may be processed partially by the aspherical surface processing method of the invention and partially by a conventional normal control processing method. Particularly, when a lens with a prism having a slope in the vicinity of the center of the workpiece 208 is processed, for example, there is a possibility of interference caused between the rotational tool 214 on the center side of the workpiece 208 and the prism in the processing method of the invention. Thus, it is effective to grind and cut a lens partially by employing a conventional normal control processing method.

(2) The aspherical surface processing method of the present invention is particularly effective for processing a periphery of a lens whose peripheral speed is high. The productivity is not so much decreased when the center and the surrounding portion are processed by a conventional normal control processing method, since the difference between the concave and convex portions at that region is small. It is thus possible to adopt the aspherical surface processing method of the present invention at the periphery of the lens and the normal control processing method at the center and the surrounding region of the lens.

(3) It is possible to adopt the aspherical surface processing method of the present invention not only for shaping the final lens surface in accordance with the prescription data for a spectacle lens, but also the method can apply to the following: an outside diameter process by cutting a lens to reduce an outside diameter; a roughing process for forming a free curve surface, a toric surface, or a spherical surface similar to the final lens surface shape; and a chamfering process for cutting sharp edges of a lens.

(4) The workpiece 208 may involve lenses of other types, molds used for casting polymerization, and others instead of spectacle lenses. Additionally, the processed surface is not limited to a concave surface but it may be used for a convex surface as well.

Combinations and subcombinations of the various embodiments described above will occur to those familiar with this field, without departing from the scope and spirit of the invention.

What is claimed is:

1. An aspherical surface processing method comprising:

providing a workpiece to be processed by rotating around a rotation axis;

providing a rotational tool movable relative to said workpiece in the same direction as the rotation axis of said workpiece and in a direction perpendicular to the rotation axis of said workpiece; and shifting said rotational tool in a fixed direction with a predetermined feed pitch in at least a partial region from a center of the rotation axis of said workpiece to a periphery of said workpiece in the direction perpendicular to the rotation axis of said workpiece to process said workpiece into a non-axisymmetrical and aspherical surface.

2. An aspherical surface processing method as set forth in claim 1, wherein said rotational tool is disposed so that a rotation center axis of a tip of said rotational tool is located in a normal direction established at a processing point of said workpiece.

3. An aspherical surface processing method as set forth in claim 1 or 2, wherein processing by said rotational tool is started from a point where the distance between the rotation center of said workpiece and the tip of said rotational tool in the direction perpendicular to the rotation axis of said workpiece is zero or approximately zero, or a point where the distance between a peripheral edge of said workpiece and the tip of said rotational tool is zero or approximately zero.

4. An aspherical surface processing method as set forth in claim 1 or 2, wherein said rotational tool is a whetstone rotating around a rotation axis.

5. An aspherical surface processing method as set forth in claim 1 or 2, wherein said rotational tool is a cutting tool rotating around a rotation axis.

6. The method as set forth in claim 1, wherein the providing of the workpiece includes a roughing step of forming said workpiece in a shape similar to a desired shape.

7. An aspherical surface processing method comprising:

providing a workpiece to be processed by rotating around a rotation axis;

providing a rotational tool movable relative to said workpiece in the same direction as the rotation axis of said workpiece and in a direction perpendicular to the rotation axis of said workpiece; and moving said rotational tool, without reciprocation, in a fixed direction with a predetermined feed pitch starting from a center of the rotation axis of said workpiece to a periphery of said workpiece, wherein said rotational tool moves in the direction perpendicular to the rotation axis of said workpiece to process said workpiece into a non-axisymmetrical and aspherical surface.

8. An aspherical surface processing method as set forth in claim 7, wherein the moving of said rotational tool patterns a spiral track.

* * * * *